US006190134B1

(12) United States Patent
Hudson

(10) Patent No.: US 6,190,134 B1
(45) Date of Patent: Feb. 20, 2001

(54) FAN BLADE STABILIZATION APPARATUS

(75) Inventor: James N. Hudson, Fort Worth, TX (US)

(73) Assignee: Molded Products Company, Haltom City, TX (US)

( * ) Notice: Under 35 U.S.C. 154(b), the term of this patent shall be extended for 0 days.

(21) Appl. No.: 09/407,254

(22) Filed: Sep. 28, 1999

(51) Int. Cl.[7] ..... F04D 29/38
(52) U.S. Cl. ..... 416/244 R; 415/216.1
(58) Field of Search ..... 416/244 R, 204 R, 416/244 A; 415/216.1; 403/373, 374.3, 383

(56) References Cited

U.S. PATENT DOCUMENTS

| | | | | |
|---|---|---|---|---|
| 4,147,470 | * | 4/1979 | Brooks et al. | 416/95 |
| 4,245,957 | * | 1/1981 | Savage et al. | 416/135 |
| 4,941,805 | * | 7/1990 | Matthews | 416/204 R |
| 5,207,561 | * | 5/1993 | Godichon | 416/134 R |
| 5,984,632 | * | 11/1999 | Lee et al. | 415/206 |
| 6,039,536 | * | 3/2000 | Van De Venne et al. | 415/216.1 |

* cited by examiner

*Primary Examiner*—Edward K. Look
*Assistant Examiner*—James M McAleenan
(74) *Attorney, Agent, or Firm*—Arthur F Zobal

(57) ABSTRACT

The apparatus includes a motor with a shaft for rotating a fan. A retaining ring and a thrust washer are located around the shaft on one side of the hub of the fan and a torque washer is located on the outer side of the hub with the end of the shaft extending through a central aperture of the torque washer. The retaining ring supports the thrust washer and the thrust washer engages and supports the hub of the fan. The aperture of the torque washer and the side of the shaft at the end thereof have planar surfaces which engage each other which prevents rotation between the torque washer and the shaft. Bosses are formed on the outer side of the hub which fit into apertures formed through the torque washer outward of the central aperture to transfer torque radially outward to the hub. A screw has a threaded shaft extending through the central aperture of the torque washer and which is screwed into a threaded aperture formed in the end of the motor shaft to tighten the torque washer to the hub. The head of the screw has serrations for engagement with the torque washer to prevent the screw from being unscrewed from the shaft during rotation.

3 Claims, 4 Drawing Sheets

FAN BLADE STABILIZATION APPARATUS

BACKGROUND OF THE INVENTION

1. Field of the Invention

The invention relates to an arrangement for attaching the hub of a fan to the shaft of a motor.

2. Description of the Prior Art

In some prior art air cooling systems used in motor vehicles employing a fan, for example, for cooling a radiator or the coils of an air conditioner, spring clips on one side of the fan have been used for holding the fan to the shaft of a motor and a drive pin coupled to the shaft and fan has been used for transmitting torque from the shaft to the fan. This arrangement sometimes has resulted in the fan pivoting or wobbling on the shaft as it rotates.

In another prior system, the fan included a hub with outer bosses and a torque washer with apertures for receiving the bosses, was attached to the end of the shaft with a screw or bolt. The same type of drive pin connection was used which also resulted in the fan pivoting or wobbling on the shaft during rotation. The screw also tended to back off or loosen over a period of time. The central hole through the fan hub for receiving the shaft had to be very precise such that a press fit occurred in order to minimize the wobble. This still resulted in a 5 percent rejection of the fans in normal production.

SUMMARY OF THE INVENTION

It is an object of the invention to provide a unique and more effective means for attaching a fan to the shaft of a motor.

The invention employs a retaining ring and a thrust washer located around the shaft on the inner side of the hub of the fan and a torque washer located on the outer side of the hub with the end of the shaft extending through a central aperture of the torque washer. The retaining ring supports the thrust washer and the thrust washer engages and supports the hub of the fan. The aperture of the torque washer and the side of the shaft at the end thereof have means which prevents rotation between the torque washer and the shaft. A threaded means with a head is screwed through the aperture of the torque washer into a threaded aperture formed in the end of the shaft, with the head engaging the torque washer. Bosses are formed on the outer side of the hub which fit in apertures formed through the torque washer radially outward of its central aperture to transfer torque to the hub radially outward. The head of the threaded means has serrations for engagement with the torque washer to prevent the threaded means from being unscrewed from the shaft during rotation.

DESCRIPTION OF THE PREFERRED EMBODIMENTS

Figure 1:
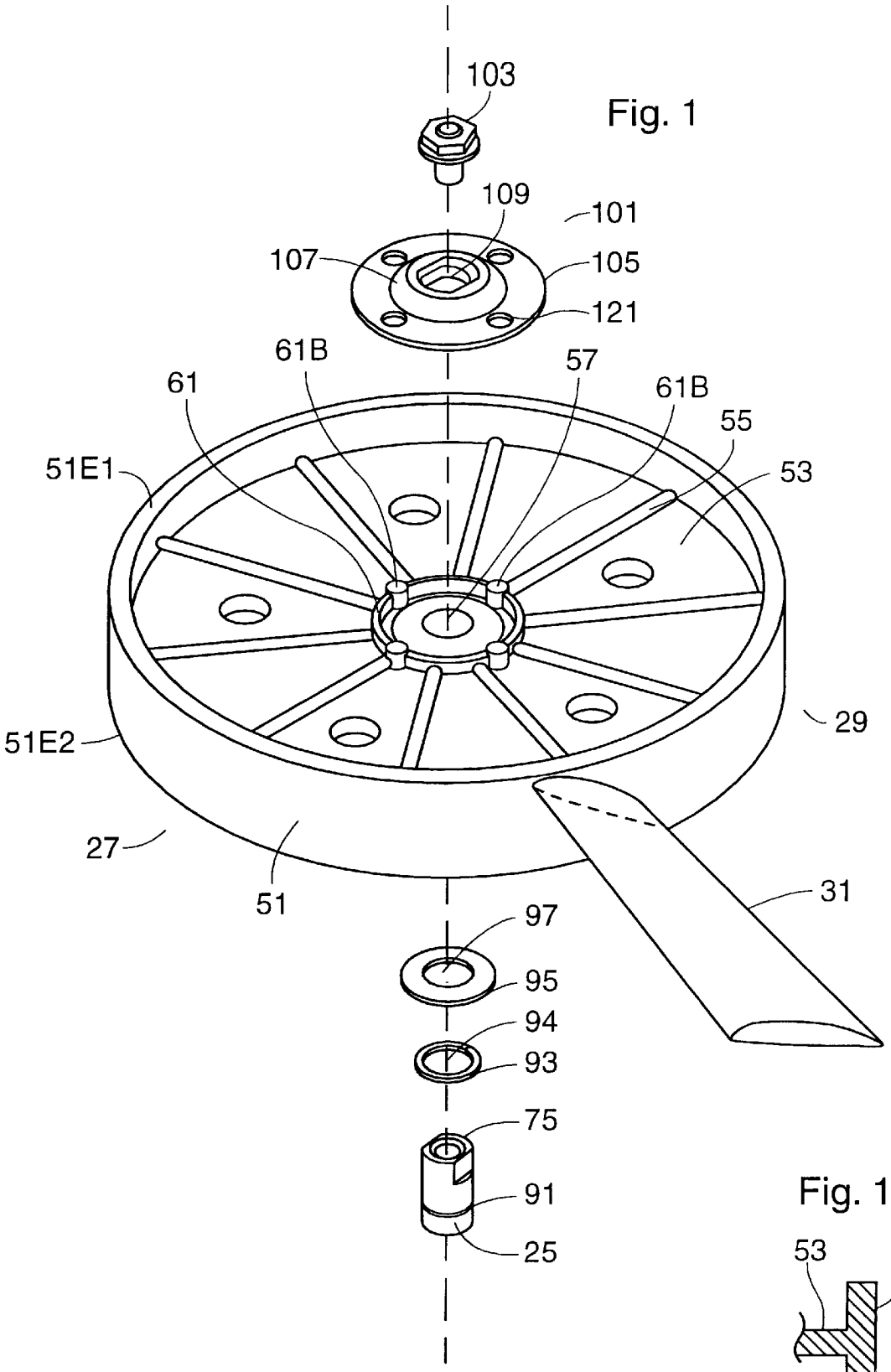
FIG. 1 is an exploded view of the apparatus of the invention.

Referring to the drawings, there is illustrated an apparatus 21 comprising an electric motor 23 having a shaft 25 which is connected to a fan comprising a hub 29 having blades 31 coupled thereto, which is located in a shroud 33 coupled to the motor 23. The motor 23 may be a DC motor having leads 35 and 37. The shroud 33 comprises radially extending arms 39 which support spaced apart annular rings 41. The apparatus may be used for example to cool a radiator or the coils of an air conditioner of a motor vehicle.

Figure 12:
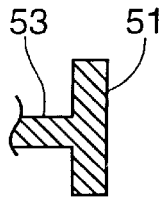
FIG. 12 is a partial cross-section of the hub of FIG. 1.
Figure 2:
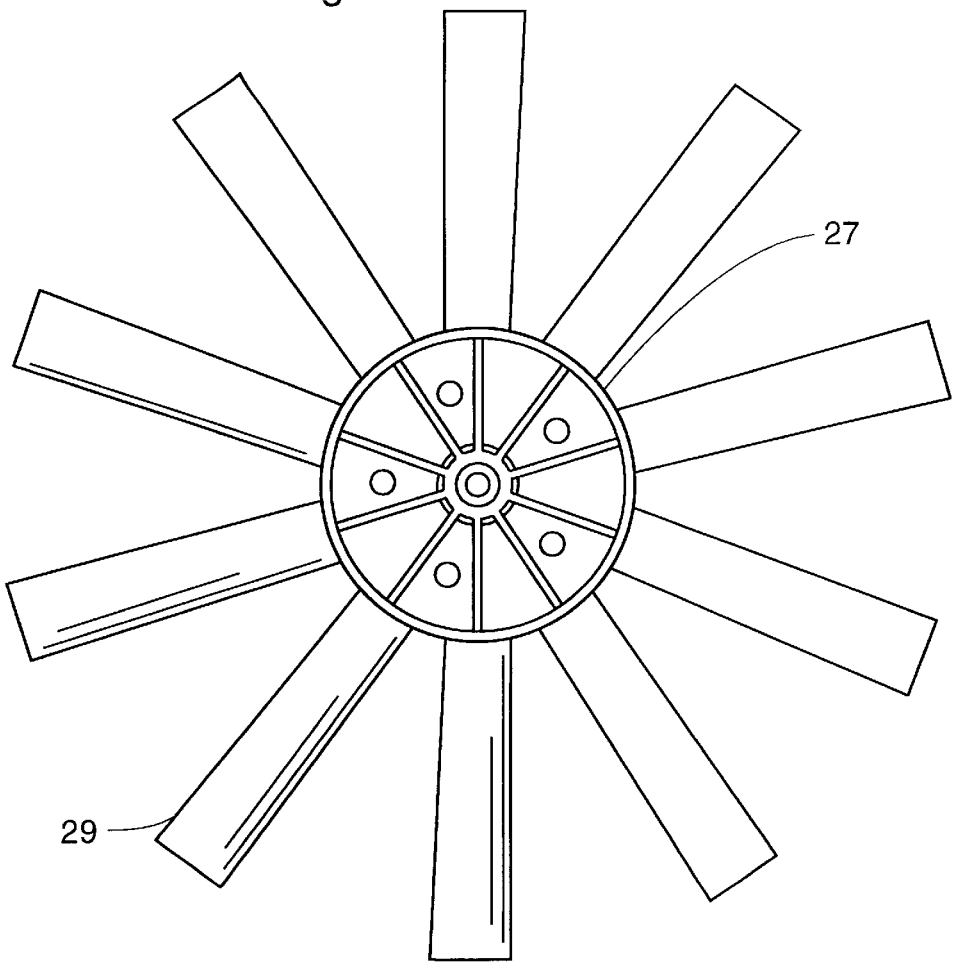
FIG. 2 is a front plan view of the fan of FIG. 1.
Figure 3:
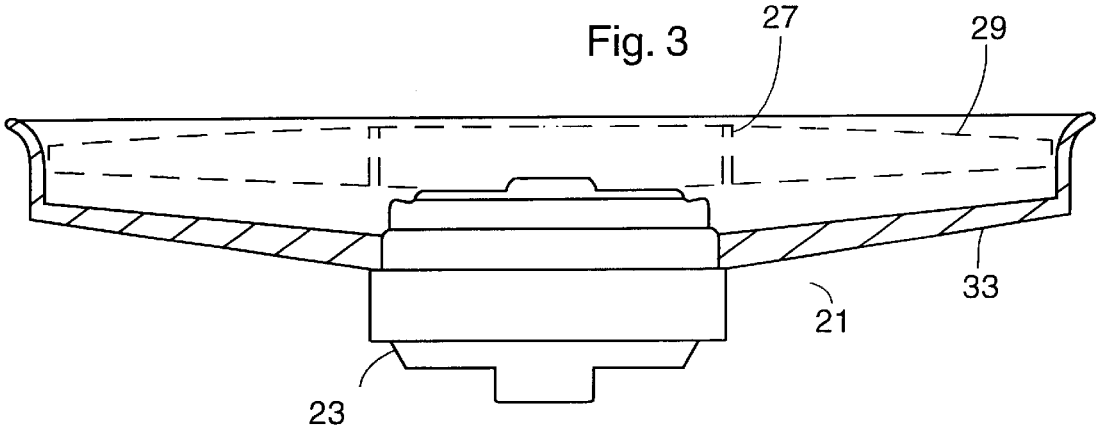
FIG. 3 is a side view of the fan of FIG. 1 located in a shroud.
Figure 4:
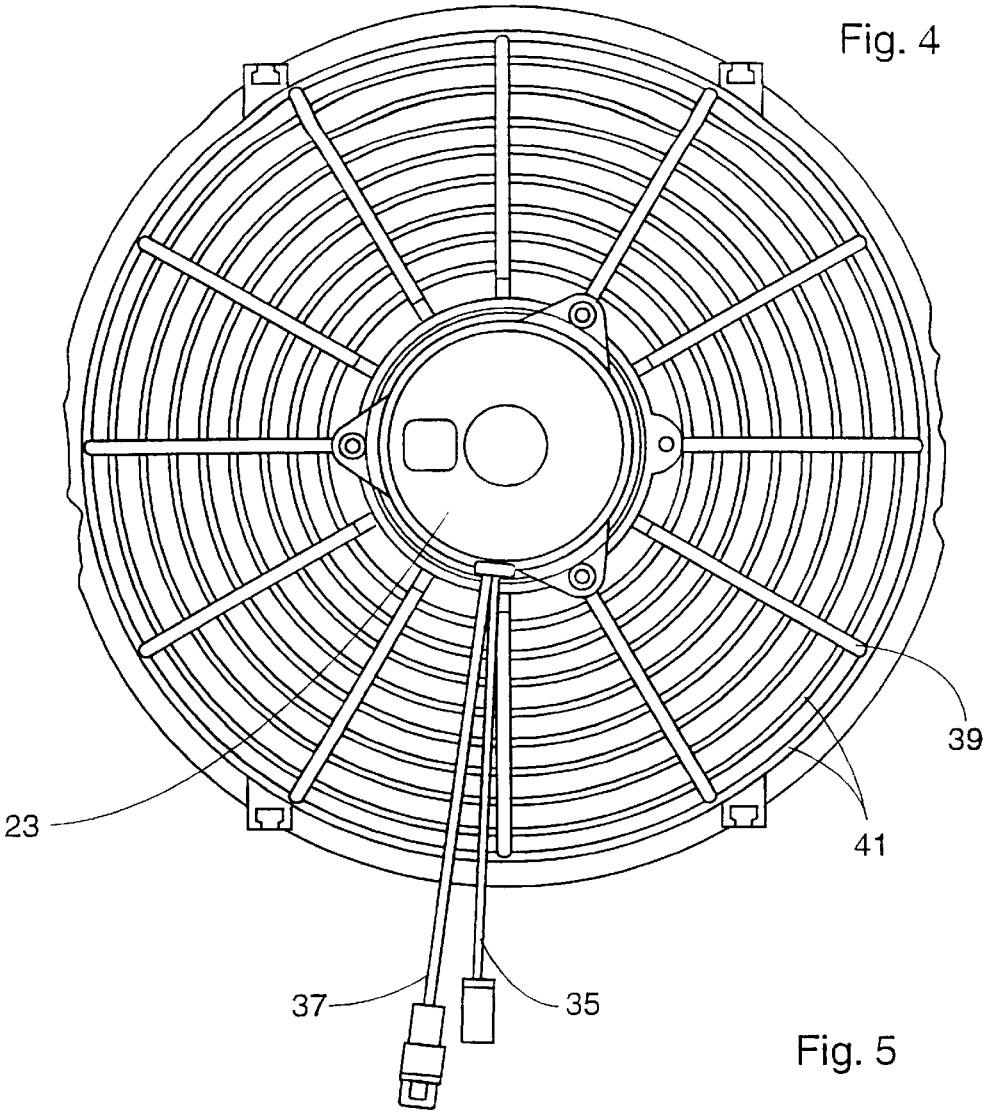
FIG. 4 is a partial rear view of the apparatus of FIG. 3.

The fan 27 is molded from a suitable plastic material as a one piece unit. The hub 29 comprises an annular rim 51 having a center plate 53 attached to the inside of the rim 51 about midway between edges 51E1 and 51E2 as shown in FIG. 12. Members 55 are ribs formed during the molding process. A central aperture 57 is formed through the plate 53. Inner rims 61 and 63 are formed radially outward of the aperture 57 on opposite sides of the plate 53. Formed as an integral part of the rims 61 and 63 are four spaced apart bosses 61B and 63B respectively. The bosses 61B and 63B extend beyond the edges 61E and 63E of the inner rims 61 and 63.

Figure 5:
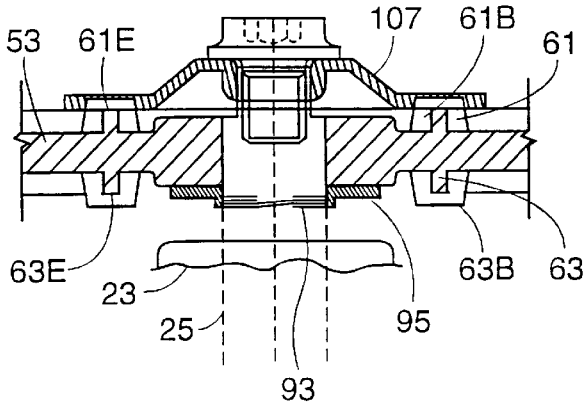
FIG. 5 is a cross-sectional view of a portion of the hub of the fan of FIG. 1.
Figure 10:
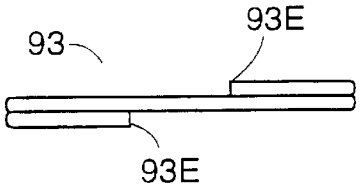
FIG. 10 is an enlarged side view of the retaining ring of FIG. 1.
Figure 9:
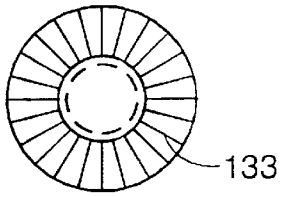
FIG. 9 is a bottom view of the screw of FIG. 8.
Figure 8:
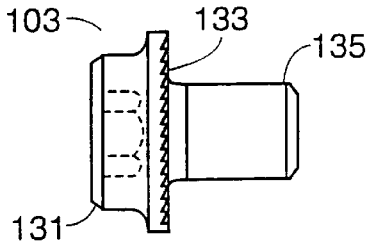
FIG. 8 is a side view of the screw shown in FIG. 1.
Figure 7:
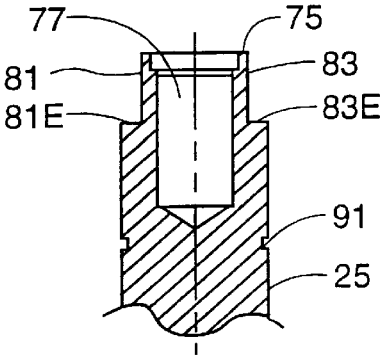
FIG. 7 is an enlarged partial cross-sectional view of the shaft of FIG. 6.
Figure 6:
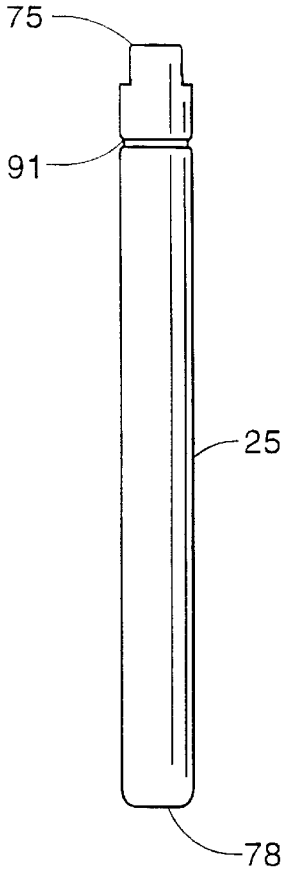
FIG. 6 is a side view of the shaft of the motor of the fan of FIG. 1.
Figure 11:
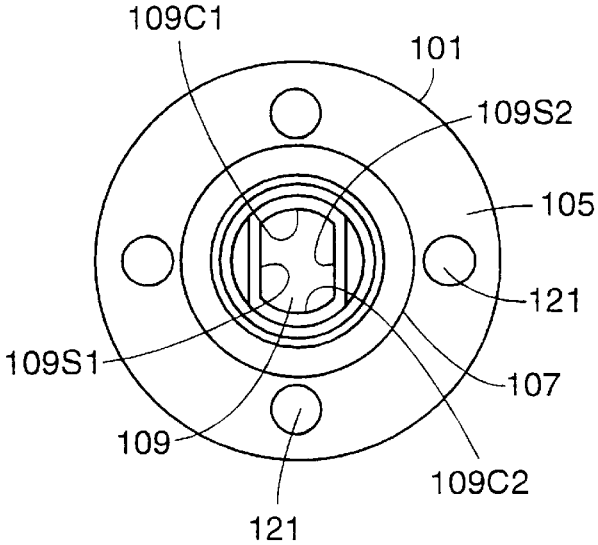
FIG. 11 is a top plan view of the torque washer of FIG. 1.

A drive or torque washer 101 and a threaded member 103 are employed for securing the fan 27 to the shaft 25. The end 75 of the shaft 25 has a threaded aperture 77 formed therein. Two parallel planar surfaces 81 and 83 are formed on the periphery of the cylindrical shaft 25 on opposite sides of the aperture 77. The surfaces 81 and 83 extend from the end 75 toward the other end 78 of the shaft 25 a short distance. Formed in the shaft is an annular slot 91 for receiving a snap ring 93 having an opening 94, which acts as a retaining ring. The slot 91 is spaced from the surfaces 81 and 83 toward the end 78. The ring 93 is a coiled spring member which can open up such that its inside diameter can be increased by applying outward pressure to its two end 93E. Also provided a thrust washer 95 with a central aperture 97 for receiving the shaft 25 and engaging the ring 91. The slot 91 is spaced from the surfaces 81 and 83 sufficient to allow the retaining ring 93 to support the thrust washer 95 and the plate 53 of the hub 29 between the ring 93 and the edges 81E and 83E of the surfaces 81 and 83 as shown in FIG. 5. When the washer 95 and the plate 53 are supported in this manner, the planar surfaces 81 and 83 extend beyond the edge 61E of the inner rim 61.

The torque washer 101 and the threaded member 103 are employed for securing the plate 53 to the shaft 25 and urging the plate 53 against the washer 95. The washer 101 comprises a round flat outer plate or rim 105 with a central raised portion 107 having a central aperture 109 formed therethrough. The aperture 109 has two straight parallel portions 109S1 and 109S2 and two arcuate portions 109C1 and 109C2 such that the aperture 109 conforms with the shape of the end 75 of the shaft 25 and can tightly receive the end 75 thereby causing the washer 101 to rotate with the shaft 25.

The round outer plate 105 of the washer 101 has four apertures 121 formed therethrough radially outward from the aperture 109 at positions to receive the four bosses 61 when the washer 101 is located in place against the rim 61 as shown in FIG. 5.

The threaded member 103 has a head 131 with serrations 133 formed on the underside thereof and a threaded shaft 135 extending from the underside of the head 133. The threaded shaft 135 of the member 103 can be screwed into the threaded aperture 77 of the shaft 25 for securing the washer 101 to the rim 61 and hence the center plate 53 of the hub 29 to the shaft 25 and against the thrust washer 95 as shown in FIG. 5. The serrations bite into the top of the raised position 107 and prevent the threaded member 103 from unscrewing when the shaft 25 is rotating the fan 27.

In assembling the apparatus, the ring 91 is located around the shaft 25 in the slot 91. The thrust washer 95 is located around the shaft 25 against the ring 91. The fan 21 is located around the shaft 25 against the thrust washer 95 with the shaft 25 extending through the central aperture 57 of the fan. The torque washer 101 is located to have its plate 105 engage the top edge 61E of the rim 61 with the bosses 61 extending into the apertures 121 of the plate 105. The threaded member 103 is screwed into the threaded aperture 77 of the shaft 25 until the serrations 133 bite into the top of the upper portion 107 of the washer 101.

The thrust washer 95 supported by the ring 93, distributes force against a broad area of the hub 29 of the fan 27 and the combination of the ring 93, the thrust washer 95, the torque washer 101 and the threaded member 103 prevents the fan 27 from pivoting or wobbling on the shaft during rotation thereof. The torque washer 101 transmits torque to the fan hub radially outward from the shaft. The serrations of the threaded member 103 prevent the threaded member 103 from backing off or unscrewing from the shaft during rotation of the shaft 25 and fan 21.

In one embodiment, the fan 27 is molded from a plastic such as NYLON. The screw 103, washer 101, washer 95, ring 93, and shaft 25 shaft 25 are formed of steel. The fan 27 may have a different number of blades 29 than ten, for example eight, or six blades.

What is claimed is:

1. An apparatus for attaching the hub of a fan to the shaft of a motor wherein the hub is formed of plastic material and comprises a center plate having an inner side and an outer side with a central aperture for receiving an end of the shaft, comprising:

a threaded aperture formed into said end of said shaft, at least one planar surface formed on the side of said shaft and extending from said end of said shaft, and an annular slot formed in said shaft around the periphery thereof at a position spaced from said end of said shaft and from said planar surface, a retaining ring located in said annular slot, a thrust washer located around said shaft against said retaining ring, said shaft extending through said central aperture of said center plate of said hub with said planar surface of said shaft extending beyond said outer side of said center plate and with said center plate of said hub engaging said thrust washer, a plurality of bosses formed on said outer side of said center plate around said central aperture, a torque washer having a central washer aperture formed therethrough with a shape conforming to the shape of said end of said shaft for receiving said end of said shaft with said end of said shaft extending beyond said outer side of said center plate of said hub, a threaded member having a head and a threaded shaft with said threaded shaft screwed into said threaded aperture of said shaft and said head engaging said torque washer, said torque washer having a plurality of apertures formed therethrough radially outward from and around said central washer aperture for receiving said bosses.

2. The apparatus of claim 1, comprising:

serrations formed on said head of said threaded member which engage said torque washer.

3. The apparatus of claim 1, wherein:

said shaft of said motor, said retaining ring, said thrust washer, said torque washer, and said threaded member are formed of metal.

* * * * *